US010987821B2

(12) United States Patent
Li

(10) Patent No.: US 10,987,821 B2
(45) Date of Patent: Apr. 27, 2021

(54) FOOD PROCESSOR

(71) Applicant: SHENZHEN LANHAIXING TECHNOLOGY CO., LTD., Shenzhen (CN)

(72) Inventor: Xiaoguang Li, Shenzhen (CN)

(73) Assignee: SHENZHEN LANHAIXING TECHNOLOGY CO., LTD, Shenzhen (CN)

( * ) Notice: Subject to any disclaimer, the term of this patent is extended or adjusted under 35 U.S.C. 154(b) by 471 days.

(21) Appl. No.: 16/068,901

(22) PCT Filed: Dec. 14, 2017

(86) PCT No.: PCT/CN2017/116235
§ 371 (c)(1),
(2) Date: Jul. 10, 2018

(87) PCT Pub. No.: WO2018/233242
PCT Pub. Date: Dec. 27, 2018

(65) Prior Publication Data

US 2020/0331162 A1 Oct. 22, 2020

(30) Foreign Application Priority Data

Jun. 20, 2017 (CN) ..... 201720717293.4

(51) Int. Cl.
*B26D 7/01* (2006.01)
*B26D 1/02* (2006.01)

(52) U.S. Cl.
CPC ..... *B26D 7/01* (2013.01); *B26D 1/02* (2013.01); *B26D 2007/011* (2013.01); *B26D 2210/02* (2013.01)

(58) Field of Classification Search
CPC ..... B26D 7/01; B26D 1/02; B26D 2007/011; B26D 2210/02; A47J 17/00
See application file for complete search history.

(56) References Cited

U.S. PATENT DOCUMENTS 6,053,098 A * 4/2000 Yamamoto ..... B26D 3/11 83/425.1
2008/0314262 A1* 12/2008 Stark ..... A47J 17/16 99/595

(Continued)

FOREIGN PATENT DOCUMENTS

CN 2416846 Y 1/2001
CN 201998195 U 10/2011

(Continued)

OTHER PUBLICATIONS

Written Opinion of the International Searching Authority for PCT/CN2017/116235.
International Search Report for PCT/CN2017/116235.

*Primary Examiner* — Omar Flores Sanchez

(57) ABSTRACT

A food processor includes a base including a first end and a second end, a fixing member, a spindle assembly, a bearing assembly, a switching member mounted on the fixing member, and a cutter. The first end is provided with a tool rest for fixing the cutter to cut food. The fixing member is mounted on the first end. The spindle assembly includes a spindle rotatably mounted on the fixing member and a fluted disc fixed to the spindle for fixing the food. The bearing assembly includes a bearing block mounted on the fixing member and a bearing mounted on the bearing block. When the switching member is in an open position, friction is generated between the bearing and the spindle. When the switching member is in a closed position, the switching member can drive the bearing away from the spindle so that the spindle can freely move.

19 Claims, 7 Drawing Sheets

(56) References Cited

U.S. PATENT DOCUMENTS

| | | | | |
|---|---|---|---|---|
| 2016/0250768 | A1* | 9/2016 | Levine | B26D 3/11<br>83/52 |
| 2016/0257013 | A1* | 9/2016 | Exley | B26D 3/11 |
| 2017/0136644 | A1 | 5/2017 | Bagley et al. | |

FOREIGN PATENT DOCUMENTS

| | | | |
|---|---|---|---|
| CN | 204263247 | U | 4/2015 |
| CN | 105520661 | A | 4/2016 |
| CN | 106490947 | A | 3/2017 |
| WO | WO2017083646 | A1 | 5/2017 |

* cited by examiner

FOOD PROCESSOR

BACKGROUND

1. Technical Field

The present disclosure generally relates to a food processor.

2. Description of Related Art

A conventional vegetable and fruit shredding machine on the market mainly shreds food by a non-transmission feed way. A cutting feed of the shredding machine is pushed by one hand and a main shaft of the shredding machine is shaken by the other hand to perform cutting food. However, the conventional shredding machine with non-transmission feed must be operated by both hands, which is difficult to operate, and the shredding thickness of vegetables and fruits is uneven by being driven with an uneven driving force.

SUMMARY

The technical problems to be solved: in view of the shortcomings of the related art, the present disclosure relates to a food processor which is convenient to use and easy to operate.

The technical solution adopted for solving technical problems of the present disclosure is:

A food processor includes a base, a fixing member, a spindle assembly, a bearing assembly, a switching member mounted on the fixing member, and a cutter. The base includes a first end and a second end. The first end is provided with a tool rest for fixing the cutter to cut food. The fixing member is mounted on the first end. The spindle assembly includes a spindle rotatably mounted on the fixing member and a fluted disc fixed to the spindle for fixing the food. The bearing assembly includes a bearing block mounted on the fixing member and a bearing mounted on the bearing block. When the switching member is in an open position, friction is generated between the bearing and the spindle to provide a feed force for driving the spindle to move. When the switching member is in a closed position, the switching member can drive the bearing away from the spindle so that the spindle can freely move.

Wherein the switching member includes an eccentric shaft mounted on the bearing block and a switch mounted on the eccentric shaft.

Wherein the bearing assembly further includes an elastic element, when the switch is in the open position, the eccentric shaft does not contact with the bearing block, the elastic element is in a free state and abutted against the bearing block so that the bearing can contact with the spindle to generate friction therebetween; when the switch is in the closed position, the eccentric shaft can drive the bearing block away from the spindle to separate the bearing from the spindle and the elastic element is in a compression state.

Wherein the fixing member includes a frame mounted on the second end via a mounting portion, and a spindle seat mounted on the frame via the mounting portion.

Wherein the mounting portion includes a mounting hole and a fixing portion, the mounting hole including a through-hole and a pair of locating holes respectively connected to the through-hole, the fixing portion passing through the through-hole and including a pair of locating blocks respectively received in a corresponding locating hole to prevent the fixing portion from rotating relative to the through-hole.

Wherein the spindle seat includes a receiving room for receiving the bearing block, the bearing and the elastic element therein.

Wherein the spindle seat further includes a first hole connected to the receiving room, one end of the spindle inserted into the first hole.

Wherein the spindle seal further includes a second hole and the bearing block includes a third hole, both the second hole and the third hole connected to the receiving room and the eccentric shaft inserted into the third hole, the receiving room and the second hole in turn.

Wherein the eccentric shaft includes a first shaft, a second shaft and a third shaft, the second shaft located between the first shaft and the third shaft, both an axis of the third shaft and an axis of the first shaft in a same line, and the axis of the first shaft and an axis of the second shaft in two different lines.

Wherein the first shaft and the third shaft are respectively received in the second hole, the second shaft received in the third hole and the switch mounted on a distal end of the third shaft.

Wherein the elastic element is received in the receiving room and located between a bottom of the bearing block and a bottom wall of the receiving room to provide an elastic force to the bearing block.

Wherein an angle is formed between the spindle and the bearing, with the angle proportional to a pitch of the movement of the spindle.

The present disclosure provides the advantages as below.

The structure of the present disclosure provides a feed force required for cutting food by using friction generated between the bearing and the spindle, thereby the food can be cut by only one hand for providing an external force to the spindle, without needing both hands to simultaneously operate the spindle. In this way, it can solve the time-consuming and laborious problem of cutting the food by using both hands in the related art and improve the convenience of use.

BRIEF DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

Figure 1:
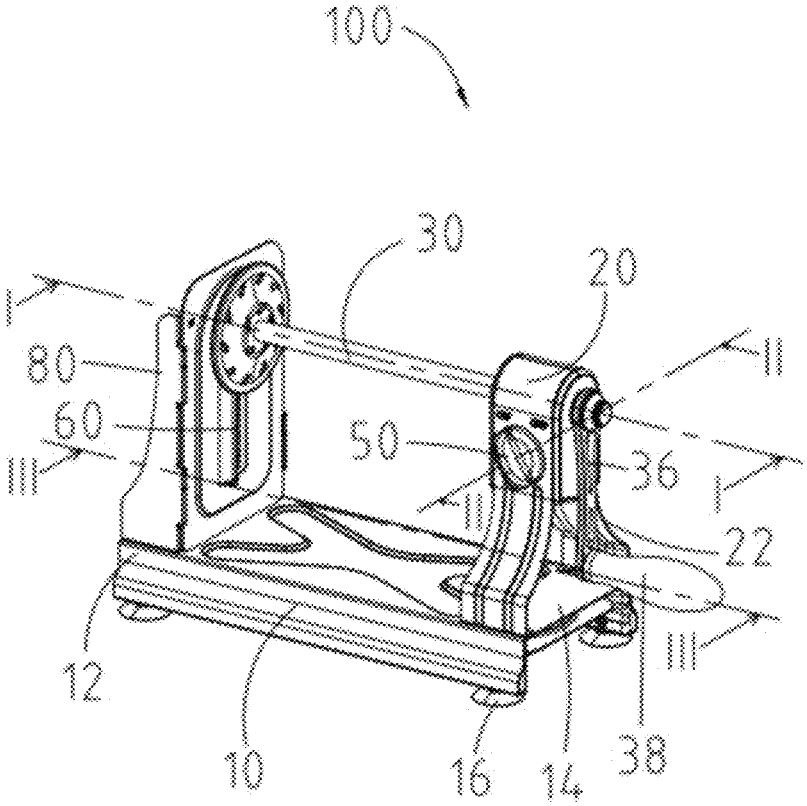
FIG. 1 is a schematic view of the food processor in accordance with an exemplary embodiment.

The disclosure is illustrated by way of example and not by way of limitation in the figures of the accompanying drawings, in which like reference numerals indicate similar elements.

Figure 2:
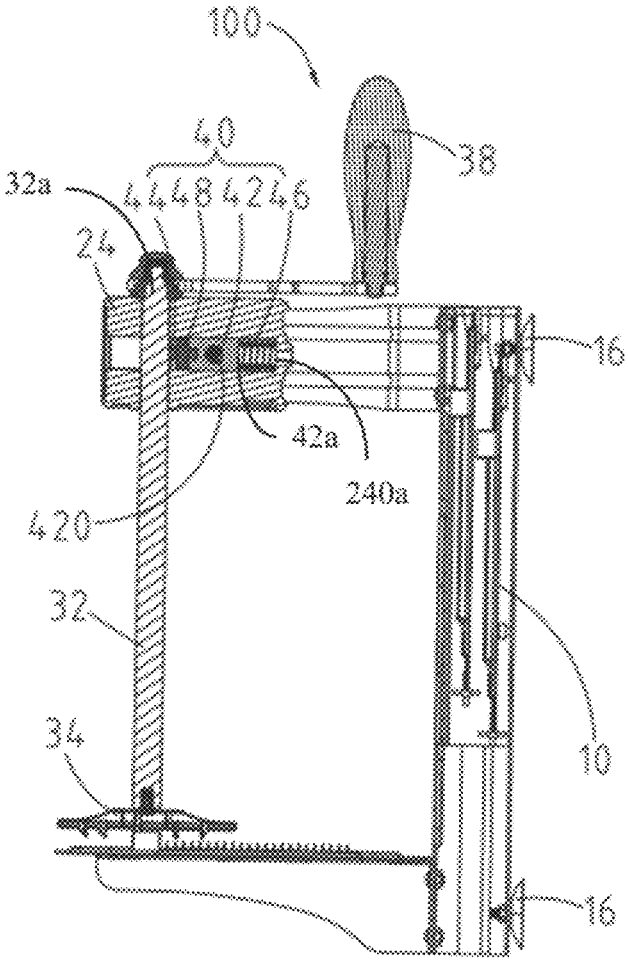
FIG. 2 is a cross-sectional view taken along the line I-I of FIG. 1.

Referring to FIG. 1 and FIG. 2, the food processor 100 accordance with an exemplary embodiment of the present disclosure includes a base 10, a fixing member 20, a spindle assembly 30, a bearing assembly 40, a switching member 50 mounted on the fixing member 20, and a cutter 60. The base 10 includes a first end 12 and a second end 14 opposite to the first end 12. The first end 12 is provided with a tool rest 80 for fixing the cutter 60 to cut food. The fixing member 20 is mounted on the first end 12. The spindle assembly 30 includes a spindle 32 rotatably mounted on the fixing member 20 and a fluted disc 34 fixed to the spindle 32 for fixing the food. The bearing assembly 40 includes a bearing block 42 mounted on the fixing member 20 and a bearing 44 mounted on the bearing block 42. The switching member 50 is mounted on the bearing block 42. When the switching member 50 is in an open position, friction is generated between the bearing 44 and the spindle 32 to provide a feed force for driving the spindle 32 to move. When the switching member 50 is in a closed position, the switching member 50 can drive the bearing 44 away from the spindle 32 so than the spindle 32 can freely move.

When using the food processor 100, the switch member 50 is first in the closed position, the food needed to cut is received in the fluted disc 34, the spindle 32 is moved close to the cutter 60 under no resistance condition. Secondly, the switch member 50 is then in the open position, the spindle 32 moves towards the food under the action of an external force, thereby causing a friction force between the spindle 32 and the bearing 44 to provide a feed force required for cutting the food. That is to say, the food processor 100 of the present disclosure can provide a feed force required for cutting the food by using friction generated between the bearing and the spindle, thereby the food can be cut with only one hand for providing an external force to the spindle, without needing both hands to simultaneously operate the spindle. In this way, it can solve the time-consuming and laborious problem of cutting the food by using both hands in the related art and improve the convenience of use.

Furthermore, when the switching member 50 is in the closed position, the switching member 40 can drive the bearing 44 away from the spindle 32 so that the spindle 32 can freely move. Thus, the spindle 32 can quickly move forward and back, which can further improve the convenience of use and the cutting efficiency.

In an exemplary embodiment of the present disclosure, the spindle 32 is an optical shaft so that food residues are not easy to remain in the spindle 32 during the food cutting process. So, It is easy to clean even if food residues are remained in the spindle 32, thereby further improving the convenience of use, and also solving the health safety hazard.

Furthermore, a certain angle is formed between the spindle 32 and the bearing 44 so that the spindle 32 can spiral forward to realize an equal pitch screw feeding. In an exemplary embodiment of the present disclosure, the angle between the spindle 32 and the bearing 44 is approximately 4 degrees, and the angle is proportional to a pitch of the movement of the spindle 32.

Since the food processor 100 of the present disclosure is fed with a constant pitch helical feed, it is easy to achieve a uniform slicing and shredding thickness during the food cutting process.

Figure 3:
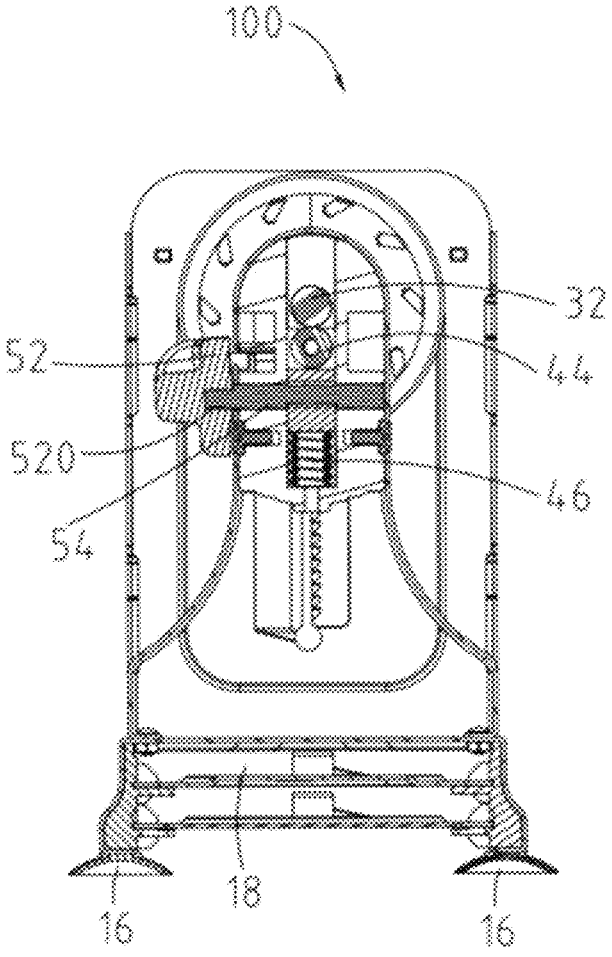
FIG. 3 is cross-sectional view taken along the line II-II of FIG. 1.
Figure 4:
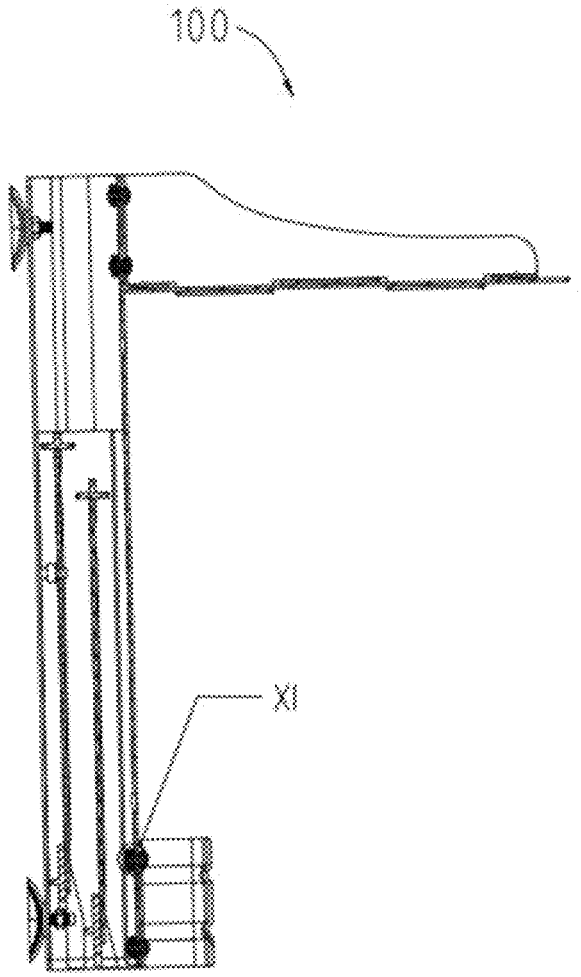
FIG. 4 is cross-sectional view taken along the line III-III of FIG. 1.
Figure 5:
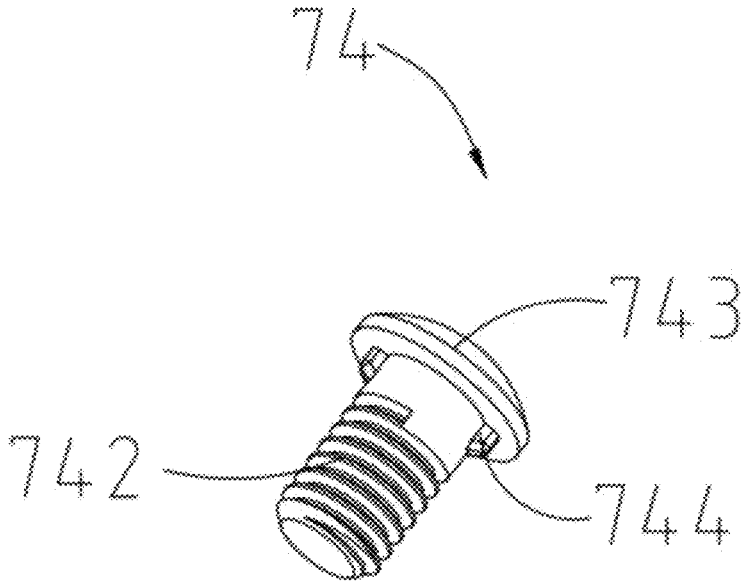
FIG. 5 is a schematic view of a fixing member of the food processor of FIG. 1.
Figure 6:
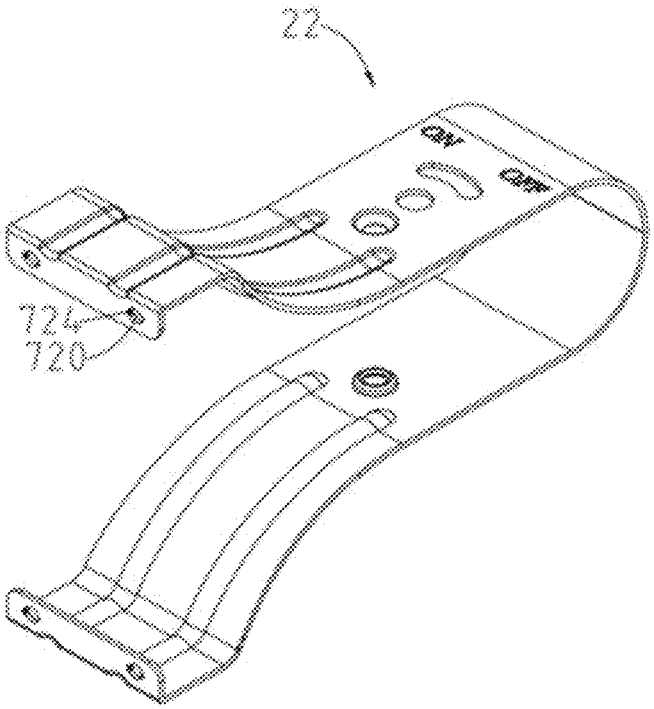
FIG. 6 is a schematic view of a frame of the food processor of FIG. 1.
Figure 7:
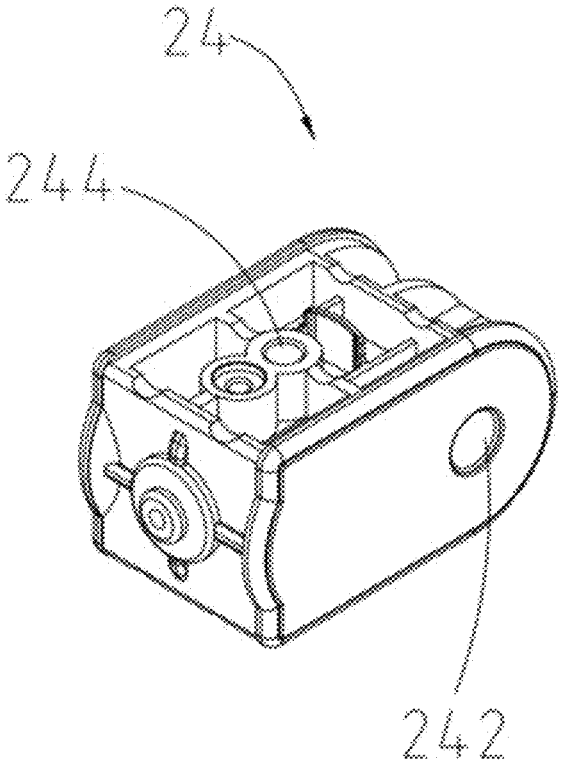
FIG. 7 is a schematic view of a spindle seat of the food processor of FIG. 1.
Figure 8:
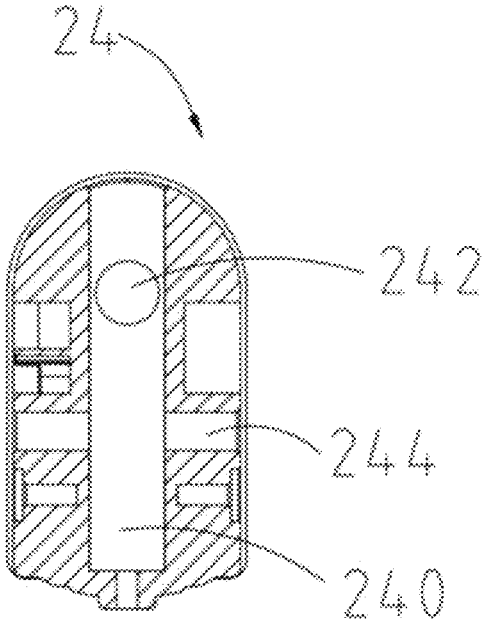
FIG. 8 is a cross-sectional view of the spindle seat of FIG. 7.
Figure 9:
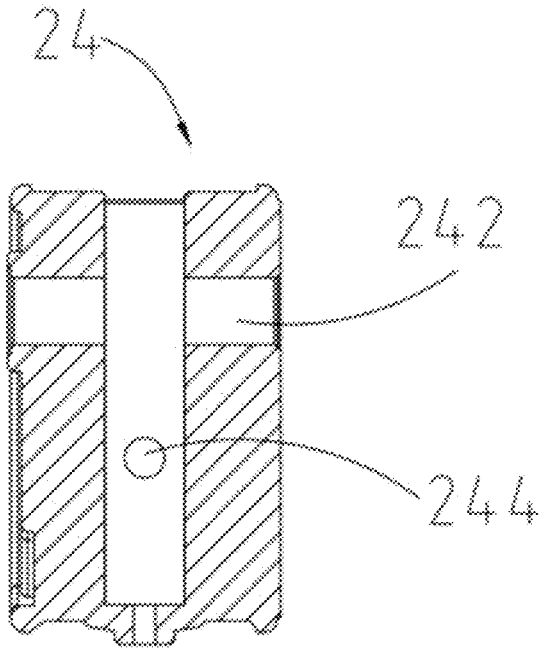
FIG. 9 is similar to FIG. 8, but shown the spindle seat from another view.
Figure 10:
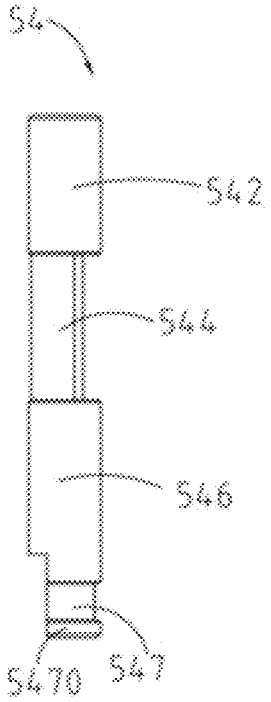
FIG. 10 is a schematic view of an eccentric shaft of the food processor of FIG. 1.
Figure 11:
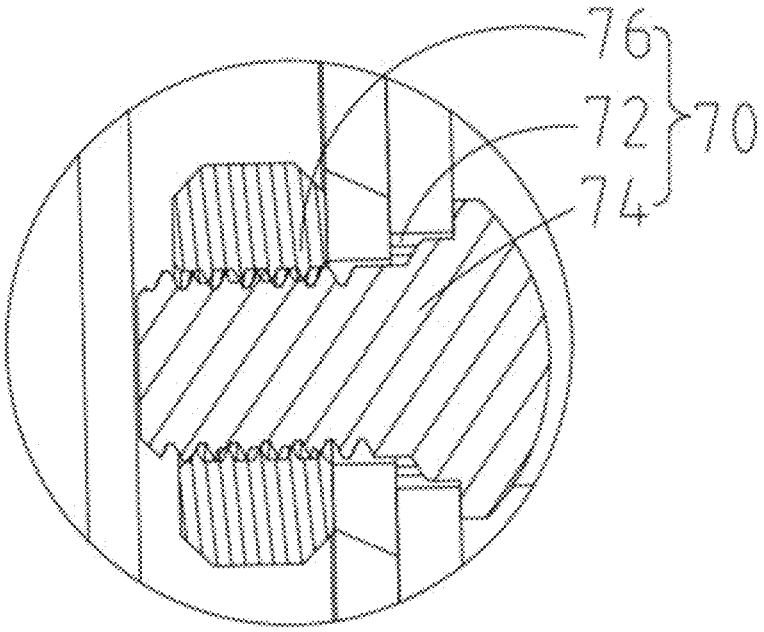
FIG. 11 is an enlarged view of circular XI of FIG. 4.

Referring to FIG. 3, the switching member 50 includes an eccentric shaft 54 mounted on the bearing block 42 and a switch 52 mounted on the eccentric shaft 54. The bearing assembly 40 further includes an elastic element 46. When the switch 52 is in the open position, the eccentric shaft 54 does not contact with the bearing block 42, and the elastic element 46 is in a free state and abutted against the bearing block 42 so that the bearing 44 can contact with the spindle 32 to generate friction therebetween, thereby the spindle 32 can spirally feed forward. When the switch 52 is in the closed position, the eccentric shaft 54 can drive the bearing block 42 away from the spindle 32 to separate the bearing 44 from the spindle 32 and the elastic element 46 is in a compression state. At this time, the spindle 32 can freely move.

In an exemplary embodiment of the present disclosure, the elastic element 46 is a wire spring and has a certain pre-pressure when at its free state.

Referring to FIG. 1., FIG. 2, FIGS. 4-6 and FIG. 11, the fixing member 20 includes a roughly V-shaped frame 22 mounted on the second end 14 via a mounting portion 70, and a spindle seat 24 mounted on the frame 22 via the mounting portion 70. The mounting portion 70 includes a mounting hole 72 and a fixing portion 74. The mounting hole 72 includes a through-hole 720 and a pair of locating holes 724 connected to the through-hole 720. The fixing portion 74 passes through the through-hole 720 and includes a pair of locating blocks 744 respectively received in a corresponding locating hole 724 to prevent the fixing portion 74 from rotating relative to the through-hole 720.

In an exemplary embodiment of the present disclosure, the fixing portion 74 is a screw structure and includes a body 742 and a head 743, and the mounting portion 70 includes a nut 76 mounted on an end of the body 742 far away from the head 743.

In an exemplary embodiment of the present disclosure, the diameter of the body 742 is less than that of the head 743. The locating block 744 protrudes from an outer surface of the body 742 and is close to the head 743, and an outer diameter of the locating block 744 is less than that of the head 743.

Since the pair of locating blocks 744 of the fixing portion 74 is received in the corresponding locating hole 724 to prevent the fixing portion 74 from rotating so that the frame 22 can be firmly mounted on the base 10 and the spindle seat 24 can be firmly mounted on the frame 22.

In an exemplary embodiment of the present disclosure, the top of the screw does not have one-word-shaped opening or a cross opening to prevent dust or food residue from remaining in the screw so that the food processor can be easy to be cleaned. At the same time, the screw is fixed into the mounting hole 72 via the nut 76, and no tools are required during assembly and maintenance of the food processor 100, thereby it is convenient to use and can further facilitate disassembling and cleaning of the food processor 100.

Referring to FIG. 1 and FIGS. 6-9, the spindle seat 24 includes a receiving room 240 for receiving the bearing block 42, the bearing 44 and the elastic element 46 therein. The spindle assembly 30 includes a rotating pole 36 mounted on the spindle 32 and a handle 38 mounted on the rotating pole 36. During use of the food processor 100, the spindle 32 can be driven to rotate by the handle 38.

Furthermore, the spindle seat 24 further includes a first hole 242 connected to the receiving room 240, and one end 32*a* of the spindle 32 is inserted into the first hole 242.

Furthermore, the spindle seat 24 further includes a second hole 244 and the bearing block 42 includes a third hole 420 (shown in FIG. 2). Both the second hole 244 and the third hole 420 are connected to the receiving room 240, and the eccentric shaft 54 is inserted into the third hole 420, the receiving room 240 and the second hole 244 in turn.

Furthermore, the elastic element 46 is received in the receiving room 240 and located between a bottom of the bearing block 42 and a bottom wall of the receiving room 240 to provide an elastic force to the bearing block 42.

Referring to FIGS. 7-10, the eccentric shaft 54 includes a first shaft 542, a second shaft 544 and a third shaft 546. The second shaft 544 is located between the first shaft 542 and the third shaft 546. Both an axis of the third shaft 546 and an axis of the first shaft 542 are in a same line, and the axis of the first shaft 542 and an axis of the second shaft 544 are in two different lines. The first shaft 542 and the third shaft 546 are respectively received in the second hole 244, and the second shaft 544 is received in the third hole 420.

In an exemplary embodiment of the present disclosure, a locating portion 547 is formed on an end of the third shall 546 and the switch 52 includes a location hole 520 for receiving the locating portion 547 therein so that the switch 52 can be fixed to the eccentric shaft 54. Furthermore, the locating portion 547 includes a protrusion 547 formed at a distal end thereof to prevent the switch 52 from accidentally disengaging from the eccentric shaft 54.

In the present disclosure, the bearing block 42 is driven to move towards the spindle 32 by the second shaft 544 of the eccentric shaft 54, thereby causing friction between the bearing 44 and the spindle 32 to provide a feed force for driving the spindle 32 to move. The bearing block 42 is driven to move away from the spindle 32 by the second shaft 544 of the eccentric shaft 54 so that the bearing 44 is separated from the spindle 32, thereby the spindle 32 can freely move. That is the spindle 32 can be quickly moved forward and backward, while the elastic element 46 is compressed.

Referring to FIGS. 1-3, the base 10 includes four sucking discs 16 arranged at four corners thereof to absorb the base 10 on an operating table, and a receiving chamber 18 formed on a bottom thereof for receiving a spare cutter 60 therein.

In an exemplary embodiment of the present disclosure, the bearing assembly 40 further includes a mandrel 48 mounted on the bearing block 42, and the bearing 44 is mounted on the bearing block 42 via the mandrel 48.

In other embodiments of the present disclosure, the mandrel 48 can be used as a part of the bearing block 42.

Referring to FIGS. 1-9, when assemble of the food processor 100, the tool rest 80 is installed at the first end 12 of the base 10, the frame 22 is installed at the second end 14 of the base 10 via the mounting portion 70. Both the elastic element 46 and the bearing assembly 40 are received in the receiving room 240 of the spindle seat 24 and the elastic element 46 is located between the bottom wall 42*a*of bearing seat 42 and the bottom wall 240*a*of receiving room 240. The spindle seat 24 is mounted on the frame 22 via the mounting portion 70, the eccentric shaft 54 is inserted into the second hole 244, the receiving room 240, and the third hole 420 in turn. The switch 52 is installed on the eccentric shaft 54 and the spindle 32 is inserted into the first hole 242. The fluted disc 34 is mounted on one end of the spindle 32 the rotating pole 36 is mounted on the other opposite end of the spindle 32, and the handle 38 is mounted on the rotating pole 36. At last, the cutter 60 is inserted into the tool seat 80. At this time, the base 10, the fixing member 20, the spindle assembly 30, the bearing assembly 40, the switching member 50 and the cutter 60 are all assembled together to obtain the food processor 100.

When using the food processor 100, the switch member 50 is first in the closed position, the food needed to cut is received in the fluted disc 34, the spindle 32 is moved close to the cutter 60 under no resistance condition. In the present disclosure, the switch 52 is a back and forth switch. Since the elastic element 46 is installed under the bearing block 42, and the elastic force of the elastic element 46 is used to support the bearing block 42 so that the friction between the bearing 44 and the spindle 32 can be generated to meet a feed force required for cutting the food. After the food is cut, the switch 52 is in the closed position again and the eccentric shaft 54 drives the spindle 32 to move away from the bearing block 42 to disengage the bearing 44 from the spindle 32 so that the spindle 32 can optionally and rapidly move. That is to say, when using the food processor 100, firstly, turn the back-and-forth switch 52 to the closed position, push the spindle 32 and insert the fluted disc 34 at the front end of the spindle 32 into a head of the vegetable or the fruit. Secondly, the back-and-forth switch 52 is turned to the opened position so that the fruits or the vegetables have been firmly fixed on the fluted disc 34. Thirdly, the spindle 32 is spiral forward with the equal pitch by gently shaking the handle 38 of the spindle 32, at this time, the cutter 60 mounted on the tool seat 80 starts cutting the fruits or the vegetables until the fruits or the vegetables are finished. Finally, the back-and-forth swatch 52 is turned to the closed position again, the spindle 32 is directly and quickly pulled to a distal end of the frame 22 and take out of a remaining tail material. Thus, the food cutting process by the food processor 100 is completed.

The food processor 100 of the present disclosure is mainly used for shredding and slicing vegetables or fruits such as turnips, potatoes, cucumbers and cabbages. The diameter of vegetables or fruits is between 25 mm and 120 mm, and the length is less than 130 mm. If the length is longer than 130 mm, it should be first cut off an exceeded part.

The food processor 100 of the present disclosure can cut the food by gently shaking the handle 38 for realizing one-hand operation, which is very simple and easy to operate. The spindle 32 can be helically feed in a uniform pitch so that the slicing and shredding thickness is uniform and labor-saving.

Furthermore, the present disclosure can be adopted an optical circular rod feeding way, during encountering impurities in fruits or vegetables, the optical circular rod can be slid off when the cutting force beyond a certain force, thereby the cutter 60 can be effectively protected. In addition, because using the optical circular rod transmission, the spindle 32 is a stainless steel rod of equal diameter, which is very easy to clean and more sanitary to improve the convenience of use.

Furthermore, the food processor 100 of the present disclosure is used the back and forth switch 52, which is very convenient to use. In this way, it can directly push the optical circular rod to any position according to the length of the food material and then open the back-and-forth switch 52 to start working.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A food processor, comprising:

a base comprising a first end and a second end opposite to the first end, the first end provided with a tool rest for fixing a cutter to cut food;

a fixing member mounted on the second end;

a spindle assembly comprising a spindle rotatably mounted on the fixing member and a fluted disc fixed to the spindle for fixing the food;

a bearing assembly comprising a bearing block mounted on the fixing member and a bearing mounted on the bearing block;

a switching member mounted on the fixing member; and wherein when the switching member is in an open position, friction is generated between the bearing and the spindle to provide a feed force for driving the spindle to move, while when the switching member is in a closed position, the switching member can drive the bearing away from the spindle so that the spindle can freely move.

2. The food processor as claimed in claim 1, wherein the switching member comprises an eccentric shaft mounted on the bearing block and a switch mounted on the eccentric shaft.

3. The food processor as claimed in claim 2, wherein the bearing assembly further comprises an elastic element, when the switch is in the open position, the eccentric shaft does not contact with the bearing block, the elastic element is in a free state and abutted against the bearing block so that the bearing can contact with the spindle to generate friction therebetween; when the switch is in the closed position, the eccentric shaft can drive the bearing block away from the spindle to separate the bearing from the spindle and the elastic element is in a compression state.

4. The food processor as claimed in claim 3, wherein the fixing member comprises a frame mounted on the second end via a mounting portion, and a spindle seat mounted on the frame via the mounting portion.

5. The food processor as claimed in claim 4, wherein the mounting portion comprises a mounting hole and a fixing portion, the mounting hole comprising a through-hole and a pair of locating holes respectively connected to the through-hole, the fixing portion passing through the through-hole and comprising a pair of locating blocks respectively received in a corresponding locating hole to prevent the fixing portion from rotating relative to the through-hole.

6. The food processor as claimed in claim 4, wherein the spindle seat comprises a receiving room for receiving the bearing block, the bearing and the elastic element therein.

7. The food processor as claimed in claim 6, wherein the spindle seat further comprises a first hole connected to the receiving room, one end of the spindle inserted into the first hole.

8. The food processor as claimed in claim 6, wherein the spindle seat further comprises a second hole and the bearing block comprises a third hole, both the second hole and the third hole connected to the receiving room and the eccentric shaft inserted into the third hole, the receiving room and the second hole in turn.

9. The food processor as claimed in claim 8, wherein the eccentric shaft comprises a first shaft, a second shaft and a third shaft, the second shaft located between the first shaft and the third shaft, both an axis of the third shaft and an axis of the first shaft in a same line, and the axis of the first shaft and an axis of the second shaft in two different lines.

10. The food processor as claimed in claim 9, wherein the first shaft and the third shaft are respectively received in the second hole, the second shaft received in the third hole and the switch mounted on a distal end of the third shaft.

11. The food processor as claimed in claim 6, wherein the elastic element is received in the receiving room and located between a bottom of the bearing block and a bottom wall of the receiving room to provide an elastic force to the bearing block.

12. The food processor as claimed in claim 1, wherein an angle is formed between the spindle and the bearing, with the angle proportional to a pitch of the movement of the spindle.

13. A food processor, comprising:

a base comprising a first end and a second end opposite to the first end, the first end provided with a tool rest for fixing a cutter to cut food;

a fixing member mounted on the second end and comprising a frame mounted on the second end via a mounting portion, and a spindle seat mounted on the frame via the mounting portion;

a spindle assembly configured to fix food and mounted on the spindle seat;

a bearing assembly mounted on the spindle seat;

a switching member mounted on the frame and configured to control a movement of the spindle assembly; and wherein the bearing assembly and the spindle assembly are cooperated to move the food with respect to the cutter to cut the food; and wherein the mounting portion comprises a mounting hole and a fixing portion, the mounting hole comprising a through-hole and a pair of locating holes respectively connected to the through-hole, the fixing portion passing through the through-hole and comprising a pair of locating blocks respectively received in a corresponding locating hole to prevent the fixing portion from rotating relative to the through-hole.

14. The food processor as claimed in claim 13, wherein the fixing portion comprises a body and a head, and the mounting portion comprises a nut mounted on an end of the body far away from the head so as to fix the fixing portion to the mounting hole.

15. The food processor as claimed in claim 13, wherein the spindle assembly comprises a spindle rotatably mounted on the spindle seat and a fluted disc fixed to the spindle; the bearing assembly comprises a bearing block mounted on the spindle seat and a bearing mounted on, the bearing block; when the switching member is in an open position, friction generated between the bearing and the spindle to provide a feed force for driving the spindle to move, while when the switching member is in a closed position, the switching member can drive the bearing away from the spindle so that the spindle can freely move.

16. The food processor as claimed in claim 15, wherein the switching, member comprises an eccentric shaft mounted on the bearing block and a switch mounted on the eccentric shaft.

17. The food processor as claimed in claim 16, wherein the bearing assembly further comprises an elastic element, when the switch is in the open position, the eccentric shaft does not contact with the bearing block, the elastic element is in a free state and abutted against the bearing block so that the bearing can contact with the spindle to generate friction therebetween; when the switch is in, the closed position, the eccentric shaft can drive the bearing block away from the spindle to separate the bearing from the spindle and the elastic element is in a compression state.

18. The food processor as claimed in claim 17, wherein the spindle seat comprises a receiving room for receiving the bearing block, the bearing and the elastic element therein.

19. The food processor as claimed in claim 13, wherein an angle is formed between the spindle and the bearing, with the angle proportional to a pitch of the movement of the spindle.

* * * * *